United States Patent [19]

Kimura

[11] 4,091,561

[45] May 30, 1978

[54] TRAVELING ROAD SYSTEM OF A TOY

[75] Inventor: Chiyuki Kimura, Showa, Japan

[73] Assignee: Okuma Seisakusho Co. Ltd., Japan

[21] Appl. No.: 769,434

[22] Filed: Feb. 17, 1977

[51] Int. Cl.[2] ..... A63H 33/00

[52] U.S. Cl. ..... 46/1 K; 46/43; 238/10 C; 273/86 F

[58] Field of Search ..... 46/1 K, 43, 235, 202, 46/216; 238/10 R, 10 A–10 C, 10 E, 10 F; 273/120, 86 B, 86 C, 86 F

[56] References Cited

U.S. PATENT DOCUMENTS

| | | | |
|---|---|---|---|
| 1,472,733 | 10/1923 | Maxwell | 273/120 R |
| 2,522,133 | 9/1950 | Sanders | 273/120 R |
| 2,634,128 | 4/1953 | Reed | 46/43 |
| 3,626,635 | 12/1971 | Birdsall | 273/86 B X |

FOREIGN PATENT DOCUMENTS

| | | | |
|---|---|---|---|
| 174,694 | 1935 | Switzerland | 46/119 |

*Primary Examiner*—Louis G. Mancene
*Assistant Examiner*—Mickey Yu
*Attorney, Agent, or Firm*—Hans Berman

[57] ABSTRACT

A toy road system includes a helical, ascending roadway fixedly mounted on a base and coaxially enveloping a column rotatably mounted on the same base. A slide is axially freely movable on the column, but secured thereto for joint angular movement. A permanent magnet on the slide may couple a toy vehicle carrying an armature to the slide so that the slide rises along the column and a coupled vehicle moves along the ascending roadway while the column turns. A descending roadway connects the two ends of the helical roadway for descent of the uncoupled vehicle by gravity.

5 Claims, 4 Drawing Figures

TRAVELING ROAD SYSTEM OF A TOY

This invention relates to a toy road system, and more particularly to a road system having a descending roadway on which a toy vehicle may travel by gravity, an ascending roadway connecting the two ends of the descending roadway, and means for moving the vehicle along the ascending roadway.

In its more specific aspects, the toy road system of the invention includes a base on which one longitudinal end portion of a column is movably mounted. A drive may turn the column about its longitudinal axis. A helical toy roadway coaxially envelops the column, one of the two axially spaced terminal portions of the helical roadway being fixedly fastened to the base. A slide is axially movable on the column and is secured thereto for joint angular movement about the column axis. A coupling member on the slide is part of a coupling arrangement for coupling a toy to the slide for joint movement along the roadway. Another toy roadway connects the two terminal portions of the helical roadway.

An embodiment of the invention is illustrated in the accompanying drawing in which.

Figure 1:
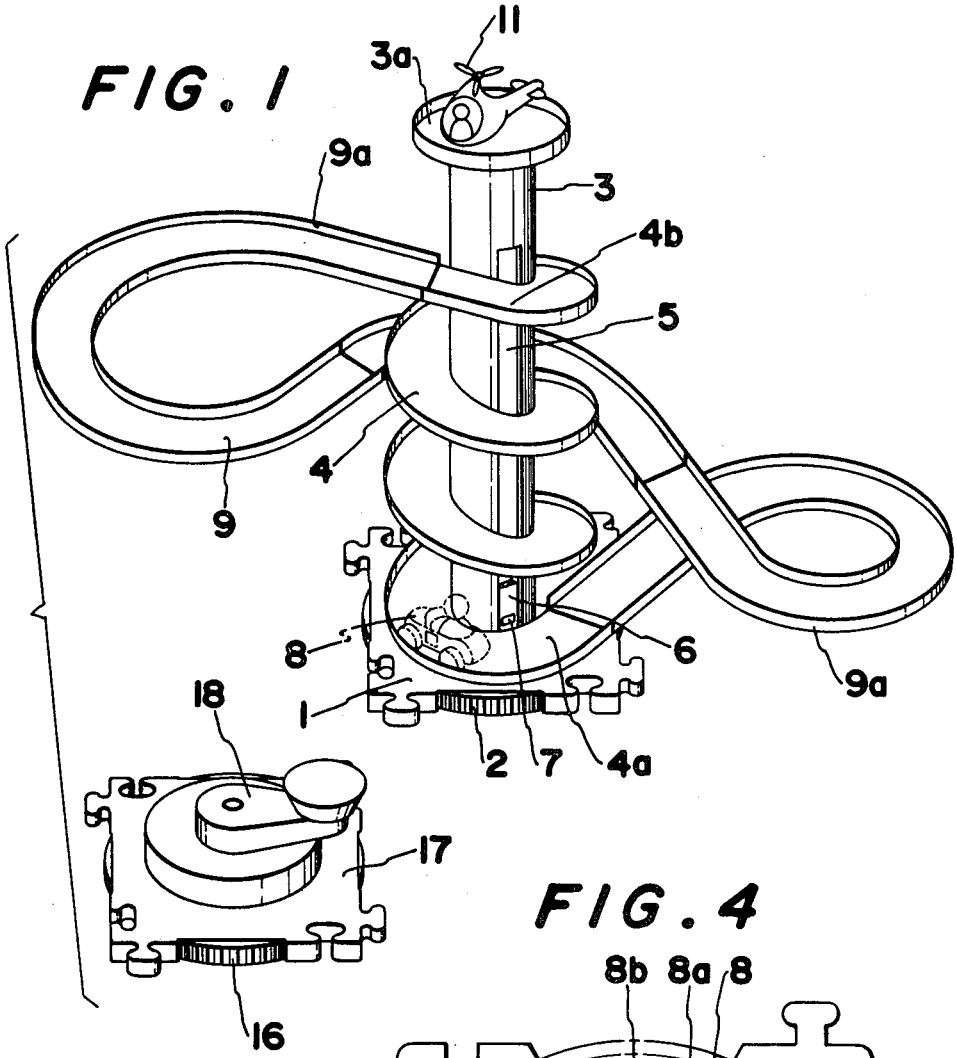
FIG. 1 shows a toy road system in a perspective view.

FIG. 1 shows a base plate 1 on which a gear 2 is mounted. A cylindrical column 3 is fastened to the gear 2 for rotation thereby about an axis perpendicular to the plate 1 and upright in the illustrated operating position of the toy road system. The lower terminal portion **4*a* of a helical ascending roadway 4 coaxially enveloping the column 3 is fixedly attached to the base plate 1. A slide 6 is axially freely movable in an axial guide groove 5 of the column 3, but secured to the column for joint angular movement about the column axis. The groove 5 extends from the lower terminal portion 4*a* to somewhat above the upper terminal portion 4*b* of the roadway 4. The slide 6 carries a permanent magnet 7 by means of which the slide may be coupled to a toy car 8 dimensioned for travel on the roadway 4. A looped descending roadway 9 having raised, longitudinal, retaining edges 9*a* connects the two terminal portions 4*a*, 4*b* of the ascending roadway 4. A platform 3*a* on the top of the column 3 carries a toy helicopter 11**.

The base plate 1 may be connected with the base plate 17 of a separate drive unit by interengaged marginal projections and recesses as is known from the commonly owned Kanda U.S. Pat. No. 3,881,274. When the base plates 1, 17 are connected, a gear 16 of the drive unit meshes with the gear 2 on the base plate 1 so that the column 3 may be turned by means of a handle 18 fastened to the gear 16.

Figure 4:
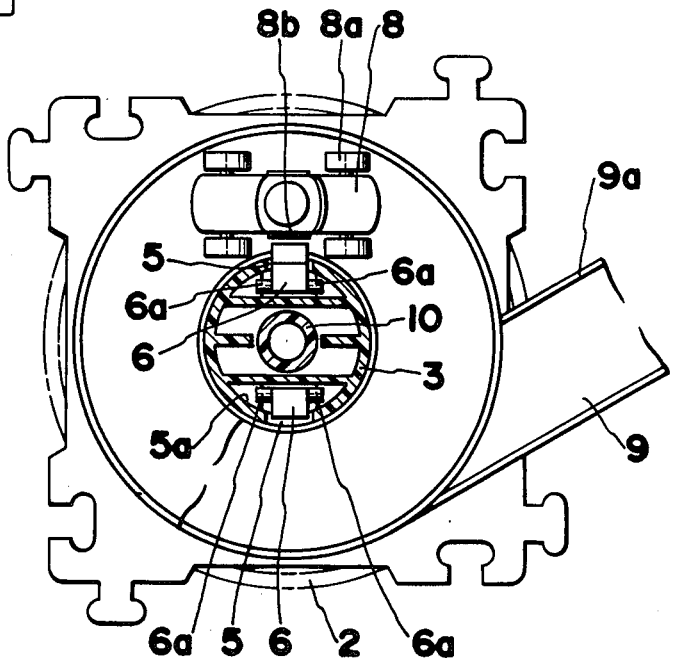
FIG. 4 is a sectional view taken on the line IV — IV in FIG. 3.
Figure 2:
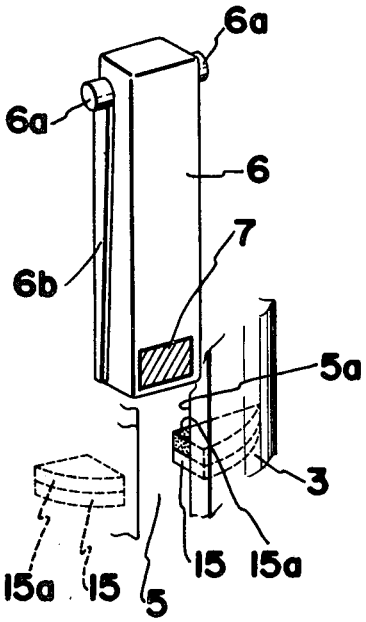
FIG. 2 is a perspective view of elements of the system of FIG. 1 on a larger scale.
Figure 3:
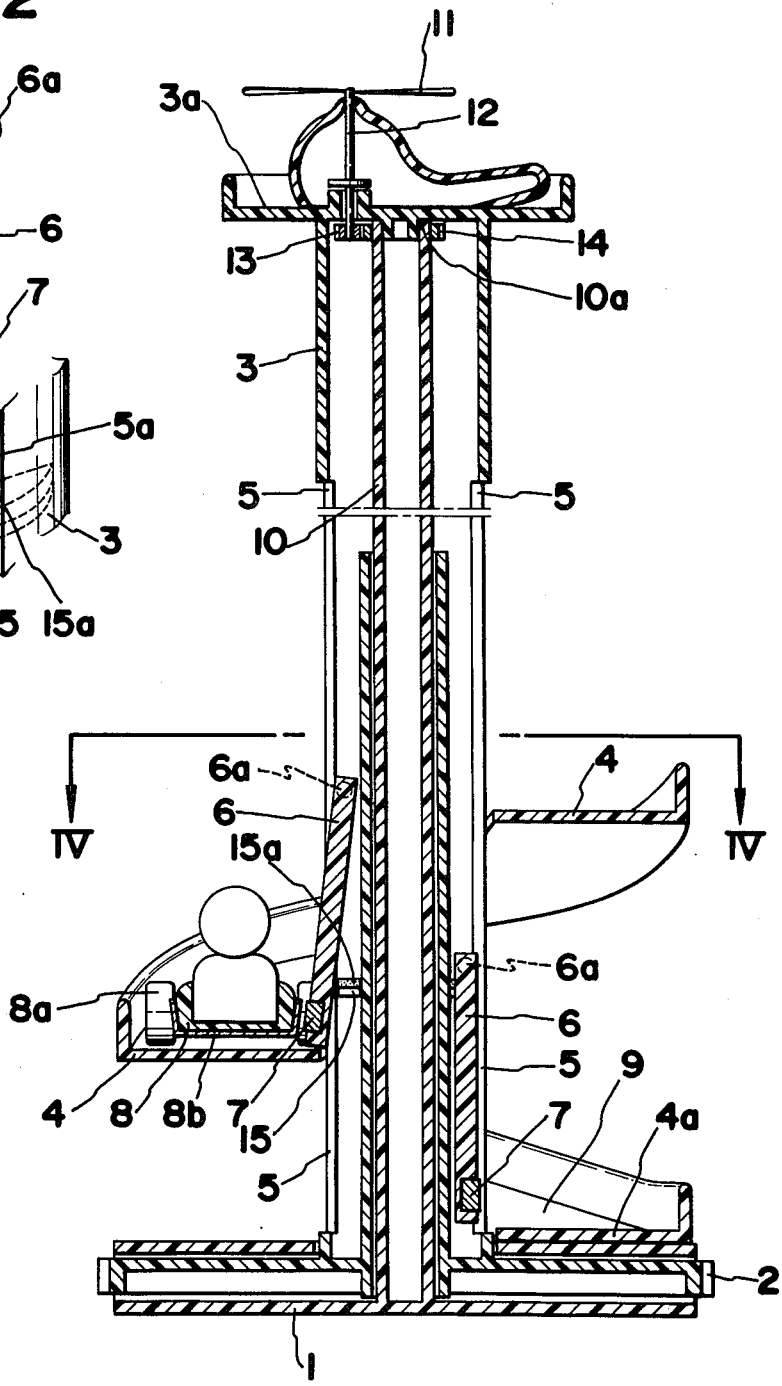
FIG. 3 illustrates a portion of the system of FIG. 1 in fragmentary elevational section.

As is shown in FIG. 3, the column 3 is tubular and has a second, identical guide groove 5 diametrically opposite the one illustrated in FIG. 1 and guiding another, identical slide 6. Each slide, as is best seen in FIG. 2, is elongated and carries two opposite transverse pins **6*a* on the upper end thereof remote from the magnet 7. As is shown in FIG. 4, the pins 6*a* are retained by projecting longitudinal edges 5*a* of the column 3 bounding the groove 5. Integral ribs 6*b* of the slide 6 taper longitudinally downward from each pin 6*a* and limit outward pivoting movement of the slide from the groove 5 on the pins 6**.

The toy car 8 travels on wheels **8*a* and has a portion 8*b* of magnetic material which provides an armature for the magnet 7. The slide 6 hangs straight down from its pins 6*a* in the absence of a car 8 as is shown on the right in FIG. 3. A car 8 entering the field of the magnet 7 on the roadway 4 causes the slide to swing outward of the groove 5 into coupling engagement with the armature-carrying car 8. Downward movement of the pins 6 in the groove 5 is limited by stops 15 on the column 3 which carry buffers 15*a***.

Another tubular column 10, fixedly fastened to the base 1, is coaxially enclosed by the column 3. The blades of the helicopter 11 are mounted on a shaft 12 which passes through the platform **3*a* and whose lower end carries a small gear 13 meshing with a larger, stationary gear on the column 10**.

The illustrated apparatus operates as follows:

When a toy car 8 is present on the lower terminal portion **4*a* of the ascending roadway 4, the lower end of a slide 6 resting on the stops 15 is swung out of the groove 5 into coupling engagement with the car 8 and movement therewith along the roadway 4 while the column 3 is turned by the handle 18 of the engaged drive unit. When the slide 6 approaches the upper end of the groove 5, it is retracted into the interior of the column 3 by the transverse end wall of the groove 5, thereby uncoupling the toy car 8 from the magnet 7, whereupon the car may descend by gravity along the roadway 9 while the uncoupled slide 6 drops to the stops 15 in the groove 5. The helicopter 11 turns with the column 3 while its blades rotate. When the car 8 reaches the lower end of the descending roadway 9 and enters the lower terminal portion 4*a* of the ascending roadway 4, the sequence of events described above is repeated as long as the column 3 is turned. Several cars may move simultaneously along the roadways 4, 9, two being capable of being raised simultaneously by the two slides 6**.

Most elements of the toy road system described and illustrated are made of plastic. The magnet and armature elements of the coupling may be interchanged. An electric motor may replace the handle 18 of the drive unit.

I claim:

1. A toy road system comprising:

(a) a base;

(b) an elongated column having a longitudinal axis, one longitudinal end portion of said column being movably mounted on said base;

(c) drive means for turning said column about said axis;

(d) a helical toy roadway coaxially enveloping said column, said roadway having two axially spaced terminal portions, one of said terminal portions being fixedly fastened to said base;

(e) a slide axially movable on said column and secured thereto for joint angular movement about said axis;

(f) coupling means for coupling a toy to said slide for joint movement along said roadway during said turning of said column, said coupling means including a coupling member on said slide; and (g) another toy roadway connecting said two terminal portions.

2. A system as set forth in claim 1, further comprising a toy vehicle dimensioned for moving along said toy roadways, said coupling means including a permanent magnet element and an armature element, one of said elements being said coupling member, the other element being on said vehicle.

3. A system as set forth in claim 2, wherein said coupling member is said permanent magnet element.

4. A system as set forth in claim 2, wherein said drive means include a gear coaxially mounted on said column, and means for meshingly engaging said gear with another, driven gear.

5. A system as set forth in claim 1, further comprising uncoupling means for uncoupling a coupled car from said slide in response to movement of said slide to one of said terminal portions.

* * * * *